US012747062B1

(12) United States Patent
Rona

(10) Patent No.: US 12,747,062 B1
(45) Date of Patent: Sep. 29, 2026

(54) MODULAR ADJUSTABLE WEIGHT CONTAINER

(71) Applicant: SIGMA CORPORATION, Cream Ridge, NJ (US)

(72) Inventor: Mitchell A. Rona, Skillman, NJ (US)

(73) Assignee: SIGMA CORPORATION, Cream Ridge, NJ (US)

( * ) Notice: Subject to any disclaimer, the term of this patent is extended or adjusted under 35 U.S.C. 154(b) by 0 days.

(21) Appl. No.: 18/802,447

(22) Filed: Aug. 13, 2024

Related U.S. Application Data

(60) Provisional application No. 63/568,670, filed on Mar. 22, 2024.

(51) Int. Cl.
*B65D 6/26* (2006.01)
*B65D 6/02* (2006.01)
*B65D 25/30* (2006.01)

(52) U.S. Cl.
CPC ..... *B65D 7/32* (2013.01); *B65D 7/06* (2013.01); *B65D 25/30* (2013.01)

(58) Field of Classification Search
CPC ..... B65D 21/08; B65D 21/083; B65D 7/32; B65D 7/06; B65D 25/30; B65D 81/361; B65D 88/005; B65D 90/023; B65D 21/0228; B65D 33/25; B65D 1/225; B65D 5/36; B65D 5/46; Y10S 229/917
See application file for complete search history.

(56) References Cited

U.S. PATENT DOCUMENTS 3,570,801 A * 3/1971 Moritz ..... B28B 7/0014 249/DIG. 4
5,419,529 A * 5/1995 Welch ..... F16M 5/00 249/149
5,597,084 A * 1/1997 Parasin ..... B65D 11/1873 220/4.28
5,950,855 A * 9/1999 Li ..... B65D 11/1846 220/4.01
6,749,077 B1 * 6/2004 McAlpine ..... B65D 11/1833 220/4.33
7,267,229 B2 * 9/2007 Chen ..... B65D 19/06 206/386
7,556,166 B2 * 7/2009 Parnall ..... B65D 11/1833 220/8
7,963,397 B2 * 6/2011 Seagle ..... B65D 19/18 220/592.01

(Continued)

*Primary Examiner* — Kareen K Thomas
(74) *Attorney, Agent, or Firm* — Caesar Rivise, PC

(57) ABSTRACT

An apparatus and method for forming a container to have a desired weight by using interchangeable sidewalls of different weights while holding contents therein. The apparatus uses a pair of cast iron end walls and a pair of cast iron sidewalls that are fastened together and to a bottom steel plate. The pair of cast iron sidewalls are available in different thicknesses to provide different sidewall weights in order to form a container of the desired weight. The operator can interchange the sidewalls if a different container weight is later required. Each sidewall has an upstanding handle on its top surface and each end wall has a handle in its top edge. The length of the interchangeable sidewalls is typically greater than the length of the end walls, whereas the heights of the interchangeable sidewalls and the end walls are identical.

5 Claims, 5 Drawing Sheets

(56) References Cited

U.S. PATENT DOCUMENTS

| | | | | |
|---|---|---|---|---|
| 8,950,613 | B2 * | 2/2015 | Nolan | B65D 19/18 220/4.31 |
| 11,498,720 | B2 * | 11/2022 | Jian | B65D 19/06 |
| 2002/0108950 | A1 * | 8/2002 | Moorman | B65D 11/1833 220/7 |
| 2007/0257033 | A1 * | 11/2007 | Yamada | H01L 21/67196 137/802 |
| 2009/0032530 | A1 * | 2/2009 | Chu | B65D 88/528 220/4.28 |
| 2013/0048632 | A1 * | 2/2013 | Chen | B65D 11/1873 220/4.33 |
| 2013/0270264 | A1 * | 10/2013 | Suljak | B65D 25/2811 220/4.03 |
| 2014/0197168 | A1 * | 7/2014 | Miller | B65D 21/0215 220/4.33 |
| 2015/0034639 | A1 * | 2/2015 | Steinwarz | G21F 5/06 164/47 |
| 2015/0239658 | A1 * | 8/2015 | Christensen | E04C 1/395 220/4.28 |
| 2015/0336732 | A1 * | 11/2015 | Denson | B65D 88/02 220/592.25 |
| 2021/0053722 | A1 * | 2/2021 | Berman | B65D 19/06 |

* cited by examiner

MODULAR ADJUSTABLE WEIGHT CONTAINER

CROSS-REFERENCE TO RELATED APPLICATIONS

This Non-Provisional application claims the benefit under 35 U.S.C. § 119 (e) of Application Ser. No. 63/568,670 filed on Mar. 22, 2024 entitled MODULAR ADJUSTABLE WEIGHT CONTAINER and whose entire disclosure is incorporated by reference herein.

BACKGROUND OF THE INVENTION

This present invention relates to containers, and more particularly, to a container having interchangeable sidewalls for adjusting the overall container weight when the container also serves as a counterweight.

In some industries, containers or enclosures for holding various types of industrial content (e.g., lithium batteries, etc.) also act as a counterweight when placed on, or are otherwise secured to, industrial equipment. Many of these containers comprise sheet metal steel fabricated boxes.

However, it is desirable to have these containers assume different weights without having to remove, or add, industrial content from/to these containers. The present invention solves these problems.

All references cited herein are incorporated herein by reference in their entireties.

BRIEF SUMMARY OF THE INVENTION

A modular adjustable weight container for holding contents therein and for also providing a desired weight is disclosed. The modular adjustable weight container comprising: a pair of cast iron end walls; a pair of cast iron sidewalls, wherein the pair of cast iron sidewalls is selected from a plurality of sidewalls having different weights (e.g., thicknesses, etc.); a steel plate which forms a bottom wall of the container; and wherein the pair of cast iron end walls and the pair of cast iron sidewalls and the steel plate are releasably secured together with fasteners (e.g., screws) to form the modular adjustable weight container.

A method for forming a modular adjustable weight container of a desired weight for holding contents therein and wherein the container with its contents is configured for providing a counterweight for another item is disclosed. The method comprises: providing a pair of cast iron end walls; providing a plurality of cast iron sidewalls having different weights (e.g., thicknesses, etc.) but similar lengths and heights; providing a steel plate for forming a bottom wall of the container; selecting two cast iron sidewalls from the plurality of the cast iron sidewalls to determine the desired weight of the container; and releasably securing (e.g., using screws) the selected two cast iron sidewalls to opposite sides of the pair of cast iron end walls and to the steel plate, thereby forming the container of the desired weight.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1:
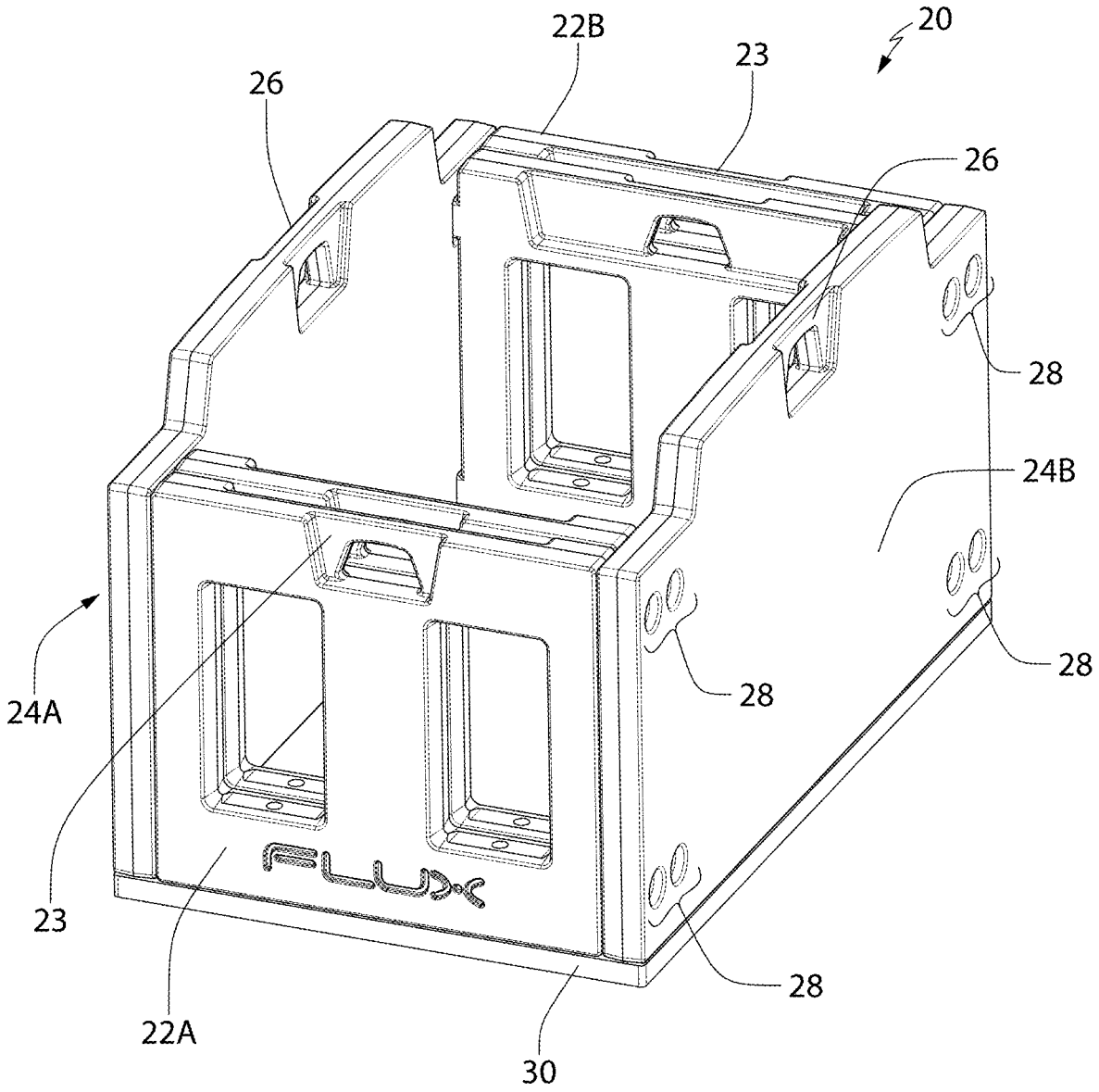
FIG. 1 is a right side isometric view of the inventive container or enclosure of the present invention.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 8:
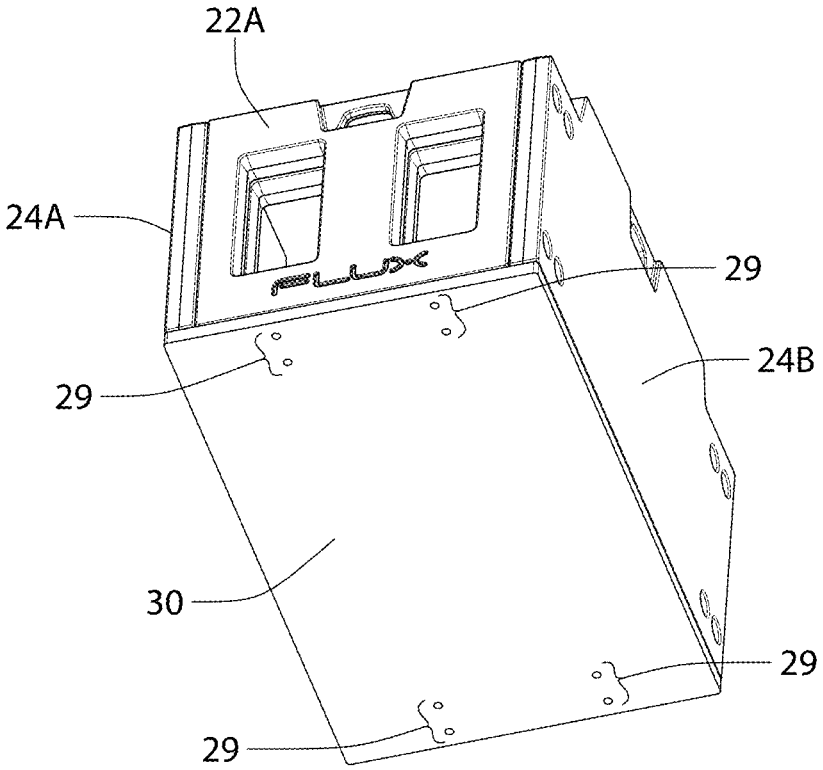
FIG. 8 is a bottom isometric view of the inventive container of the present invention depicting the apertures for receiving fasteners for securing the bottom to the end walls.

As shown in FIG. 1, the inventive container or enclosure 20 comprises two end walls 22A and 22B, each having a grip 23. The container or enclosure 20 (hereinafter "container 20") also comprises two sidewalls 24A and 24B, each having an upstanding handle 26, as this handle 26 projects upward from the top edge 27 (FIG. 4) of the sidewall 24A/24B. The container 20 also comprises a bottom wall 30. The outside surface of the sidewalls 24A/24B comprise double apertures 28 for receiving fasteners (e.g., screws, not shown) therein which releasably secure the sidewalls 24A/24B to the end walls 22A/22B. Although not shown, fasteners are also used to releasably secure the bottom wall 30, through apertures 29 (see FIG. 8), to the pair of end walls 22A/22B. Furthermore, to facilitate assembly of the container 20, the inside surface (FIG. 8) of the sidewalls 24A/24B comprise a pair of sockets 28A in their corners, aligned with respective ones of the double apertures 28, to receive protrusions 28B on the sides of the end walls 22A/22B; thus, with the projections 28B seated within the sockets 28A, the fasteners (not shown) can be inserted into the double apertures 28 to releasable secure the sidewalls 24A/24B to the end walls 22A/22B through each of the socket 28A/protrusion 28B coupling.

Figure 2:
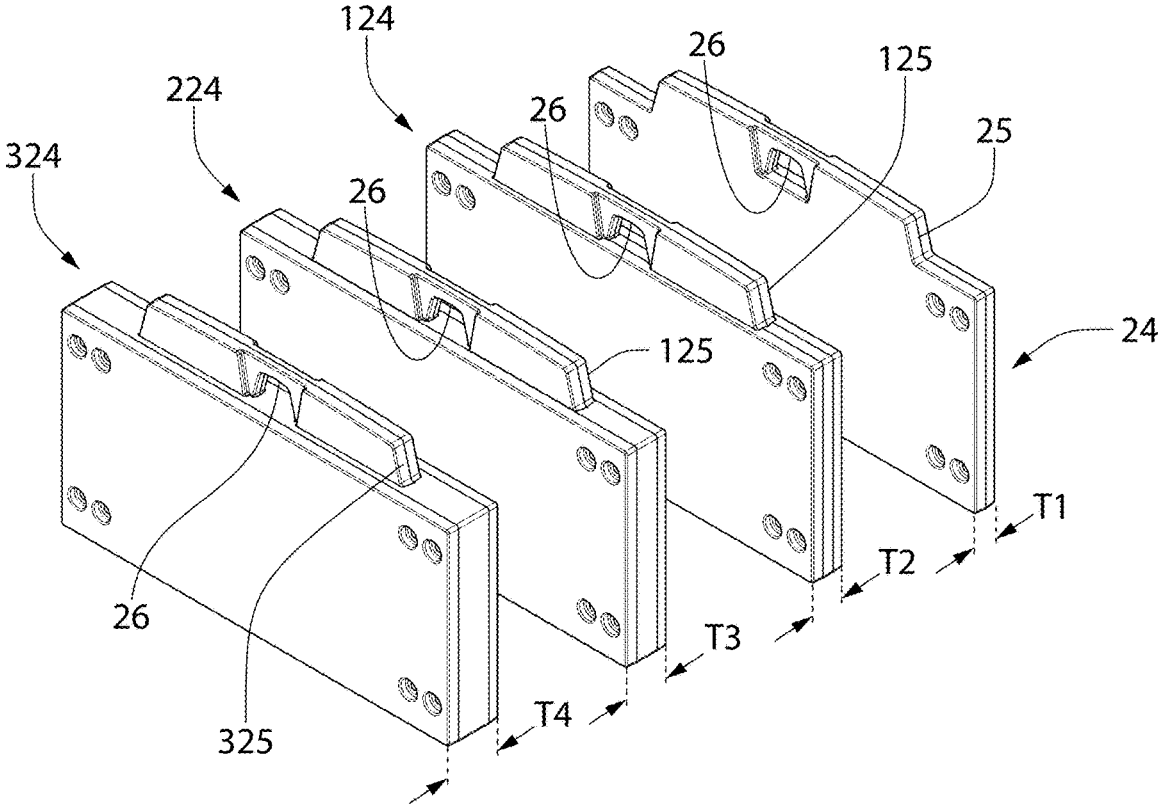
FIG. 2 are isometric views of sidewalls of different thicknesses (e.g., weights) for use in forming the inventive container or enclosure of the present invention.
Figure 3:
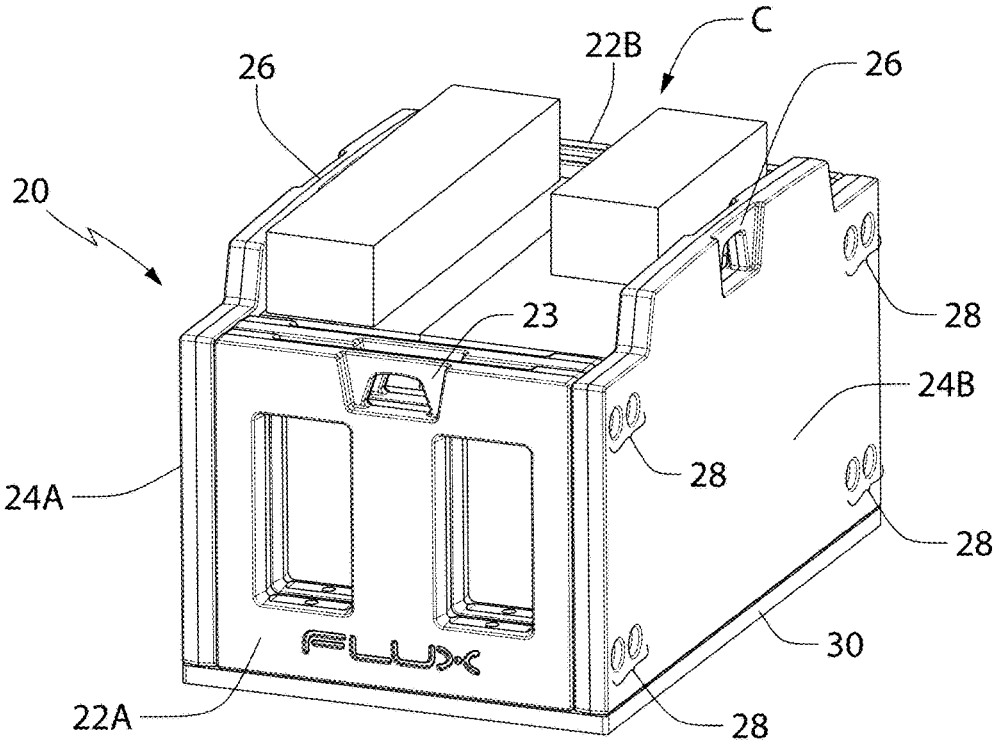
FIG. 3 is an isometric view of the inventive container or enclosure of the present invention with industrial content placed therein.
Figure 4:
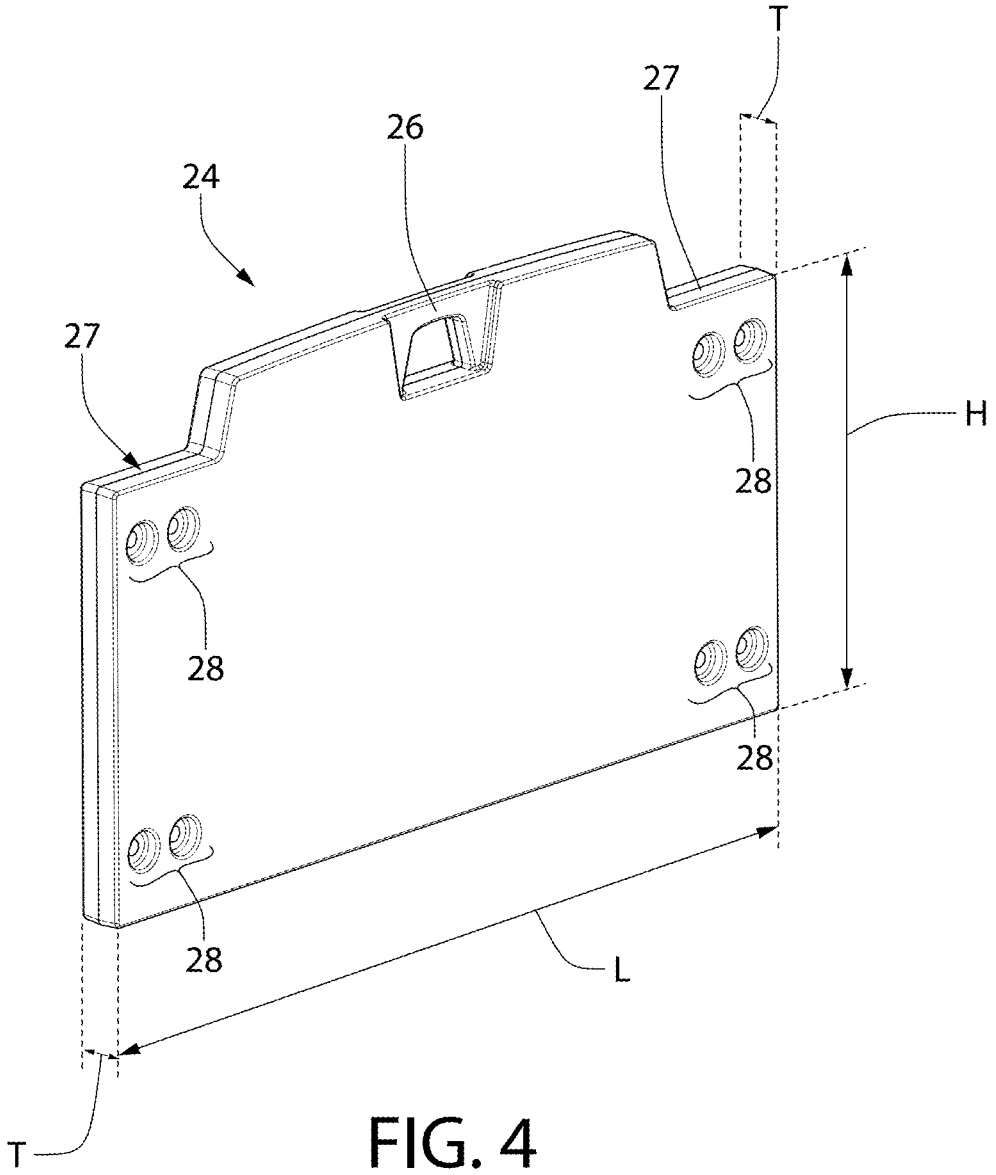
FIG. 4 defines the length, height, and thickness dimensions of an interchangeable sidewall.
Figure 5:
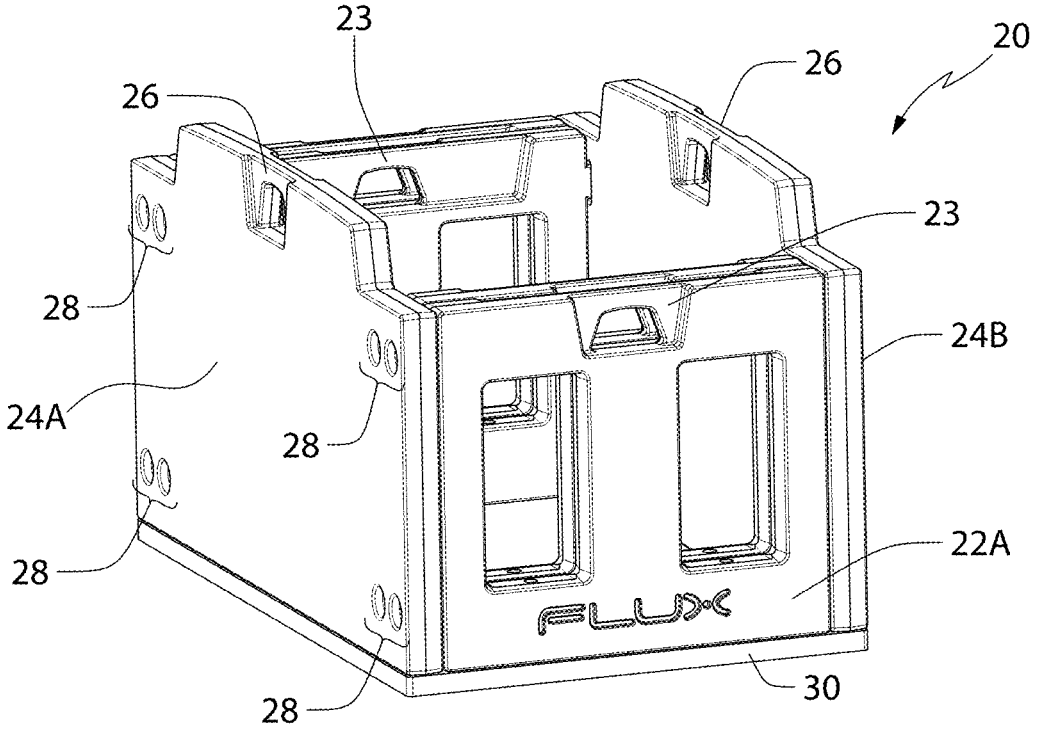
FIG. 5 is a left side isometric view of the inventive container or enclosure of the present invention.
Figure 6:
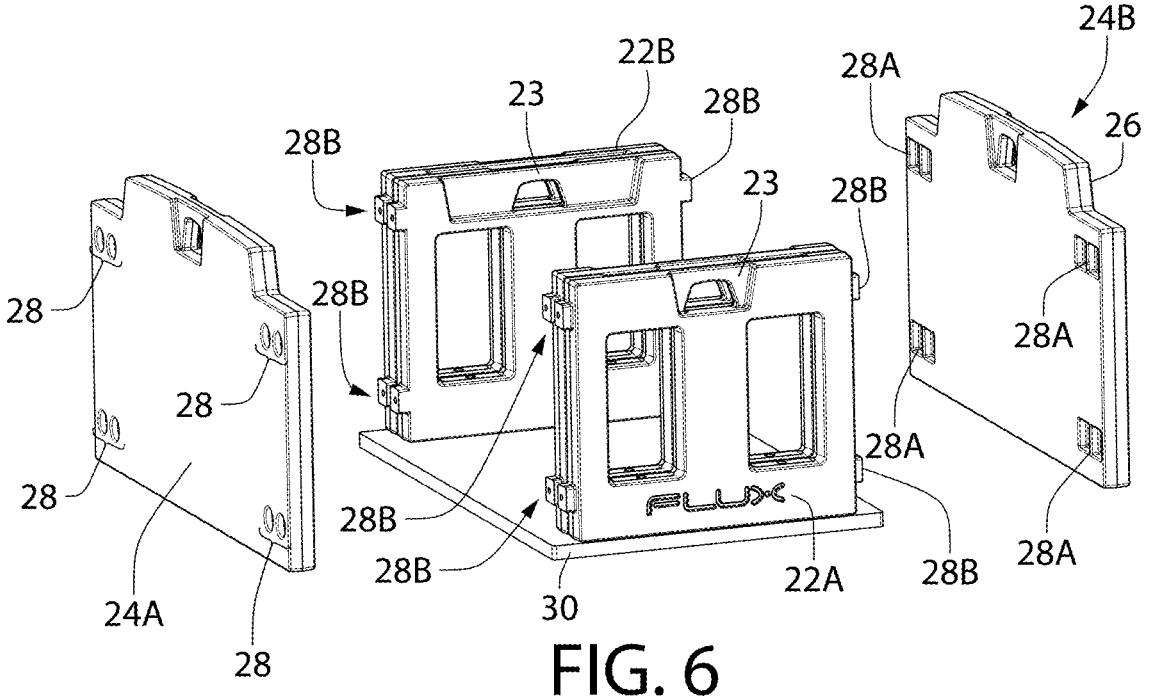
FIG. 6 is an exploded view of the inventive container of the present invention.
Figure 7:
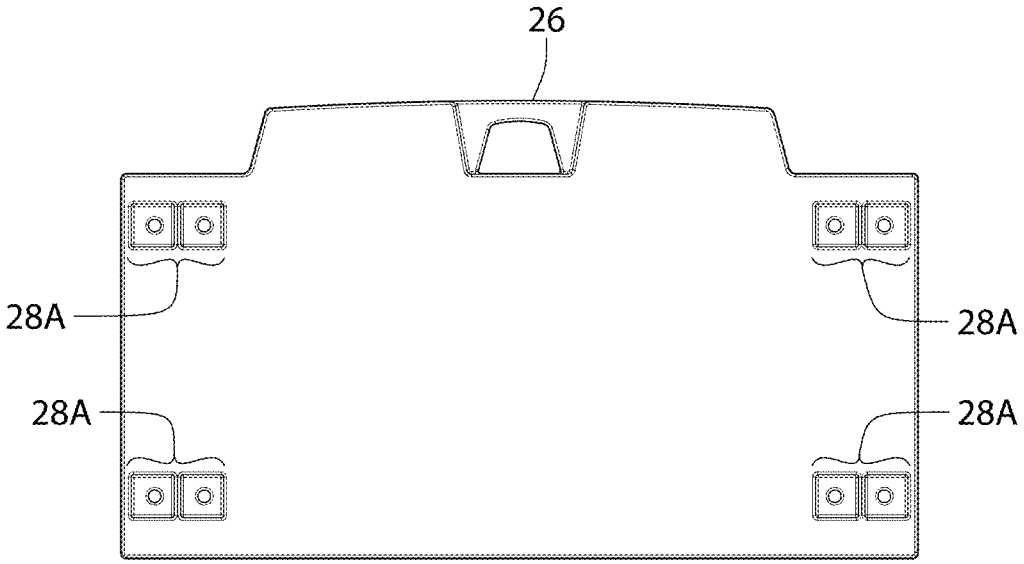
FIG. 7 is a plan view of the inside surface of the sidewall of the present invention depicting the pair of sockets in each corner of the sidewall.

The key feature of the inventive container 20 are the interchangeable sidewalls 24, 124, 224 and 324 shown in FIG. 2. This interchangeability supports the "modular" nature of the container 20. As shown in FIG. 4, each of these interchangeable sidewalls comprises a unique thickness (T) and weight, whereas the height (H) and length (L) of each sidewall is the same. Thus, if the operator wishes to form a container 20 of a particular weight, he/she would select two panels 24 (having thickness T1, FIG. 2) to form a left sidewall 24A and a right sidewall 24B of the container 20 which are then fastened to the end walls 22A/22B, and to the bottom panel 30. Using two sidewalls 24 would result in a container 20 having the lightest container weight. Should the operator want a container 20 of a slightly heavier overall weight, he/she would select two sidewalls 124 (having thickness T2, FIG. 2) to form the left sidewall and the right sidewall. If an even more heavier container 20 is desired, the operator would select two sidewalls 224 (having thickness T3, FIG. 2) to form the left sidewall and the right sidewall. Finally, the heaviest container 20 would be formed by the operator selecting two sidewalls 324 (having thickness T4, FIG. 2) to form the left sidewall and the right sidewall. As a result, the end walls 22A/22B always remain the same; only the sidewalls are interchanged for achieving different container 20 weights.

It should be noted that the thickness of the supports of the upstanding handle 26 on the sidewalls 24, 124/224, and 324 also increase. In particular, support 25 of the upstanding handle 26 on sidewall 24 has the smallest thickness; supports 125 and 225 of the upstanding handles 26 on respective sidewalls 124 and 224 have the next greater thickness; and support 325 of the upstanding handle 26 on sidewall 324 has the greatest thickness.

Additionally, since the lengths (L) and heights (H) of the different sidewalls 24, 124, 224 and 324 are the same, it is possible to form the container 20 having sidewalls of different thicknesses. For example, the user could use a sidewall 124 to form the right or left sidewall and a sidewall 224 to form the remaining sidewall to achieve a particular desired container 20 weight. Although this use of sidewalls of different thicknesses in one container 20 is not preferred, it is an available option.

By way of example only, the following weights for the differently-sized sidewalls may comprise as shown in Table 1 below:

TABLE 1

| Sidewall Version | Weight (lbs.) |
|---|---|
| 24 | 1350 lbs. |
| 124 | 1808 lbs. |
| 224 | 2106 lbs. |
| 324 | 2718 lbs. |

Once the industrial content C is positioned within the container 20, the container 20 now forms a counterweight for use on the industrial equipment (not shown) to stabilize it from rocking or tipping over. Therefore, by providing four interchangeable sidewalls of different thicknesses/weight, a large variety of different total weights of the container 20 can be offered to the operator. Applicant can provide a solution for different total container weights using modular casting plates whereby the shorter end plates (i.e., end walls 22A/22B) can be utilized on all container versions 20 and the side longer plate (i.e., the sidewalls 24, 124, 224, 324) requires only one additional casting plate per size.

As a result, should the operator wish to change the container 20 weight, he/she can remove the content C from the container 20 and then disengage the fasteners to release the two sidewalls. The operator would then select another pair of sidewalls, having thicknesses/weights that would achieve the operator's goal of having the container 20 comprise a certain weight. He/she would then releasably secure the two newly-selected sidewalls to the pair of end walls 22A/22B and to the bottom wall 30. Once secured, the contents C can be reinstalled within the container 20.

It should be noted that the upstanding handles (26, 126, 226 and 326—see FIG. 2) vary in thickness in accordance with the thickness (T) of the respective sidewall 24, 124, 224 and 324.

The container walls 22A/22B and sidewalls (24, 124, 224 and 324) comprise cast iron castings, as opposed to sheet metal steel fabricated plates, as exists in conventional storage container boxes.

While the invention has been described in detail and with reference to specific examples thereof, it will be apparent to one skilled in the art that various changes and modifications can be made therein without departing from the spirit and scope thereof.

What is claimed is:

1. A modular adjustable weight container for holding contents therein and for also providing a desired weight, said modular adjustable weight container comprising:

a pair of cast iron end walls and wherein each one of said pair of cast iron end walls comprises a handle;

a pair of cast iron sidewalls, said pair of cast iron sidewalls being selected from a plurality of sidewalls having different weights, and wherein each one of said pair of cast iron sidewalls comprises a handle that is elevated above a top edge of each of said sidewalls;

a steel plate which forms a bottom wall of said container; and wherein said pair of cast iron end walls and said pair of cast iron sidewalls and said steel plate are releasably secured together with fasteners to form said modular adjustable weight container.

2. The modular adjustable weight container of claim 1 wherein said pair of cast iron end walls have a first height and wherein said pair of cast iron sidewalls comprise a height of said first height.

3. The modular adjustable weight container of claim 1 wherein said plurality of sidewalls having different thicknesses.

4. The modular adjustable weight container of claim 1 wherein said pair of cast iron end walls comprise a first length and said pair of cast iron sidewalls comprise a second length, said second length being greater than said first length.

5. The modular adjustable weight container of claim 1 wherein said fasteners comprise screws.

* * * * *